US005865638A

United States Patent [19]

Trafton

[11] Patent Number: 5,865,638

[45] Date of Patent: Feb. 2, 1999

[54] ELECTRICAL CONNECTOR

[75] Inventor: Michael L. Trafton, Dearborn, Mich.

[73] Assignee: Alcoa Fujikura Ltd., Brentwood, Tenn.

[21] Appl. No.: 926,339

[22] Filed: Sep. 5, 1997

Related U.S. Application Data

[63] Continuation of Ser. No. 576,782, Dec. 21, 1995, abandoned.

[51] Int. Cl.[6] ..... H01R 25/00

[52] U.S. Cl. ..... 439/288; 439/927

[58] Field of Search ..... 439/288, 287, 439/289, 927

[56] References Cited

U.S. PATENT DOCUMENTS

| | | | |
|---|---|---|---|
| 3,316,522 | 4/1967 | Demler | 439/288 |
| 3,480,903 | 11/1969 | Filson | 439/288 |
| 4,023,882 | 5/1977 | Pettersson | 439/927 |
| 4,357,070 | 11/1982 | Fukushima et al. | 439/288 |
| 4,943,247 | 7/1990 | Wise | 439/927 |
| 5,188,544 | 2/1993 | Mukai | 439/287 |

*Primary Examiner*—Neil Abrams
*Assistant Examiner*—T C Patel
*Attorney, Agent, or Firm*—Gifford, Krass, Groh, Sprinkle, Patmore, Anderson & Citkowski, P.C.

[57] ABSTRACT

An electrical conductor establishes electrical contact between planar faces of a first terminal and a second terminal. The connector includes a resilient contact plate disposed between the faces, and locking assembly for retaining the terminals in engagement. A sealing gasket may be included, and the connector may be configured to join a number of separate wire pairs.

11 Claims, 3 Drawing Sheets

10
20
26
22
14
12
24
16
18

12
22
10
16
24
30
36
32
34
26
20
38
38
14
18
28
38

FIG-3
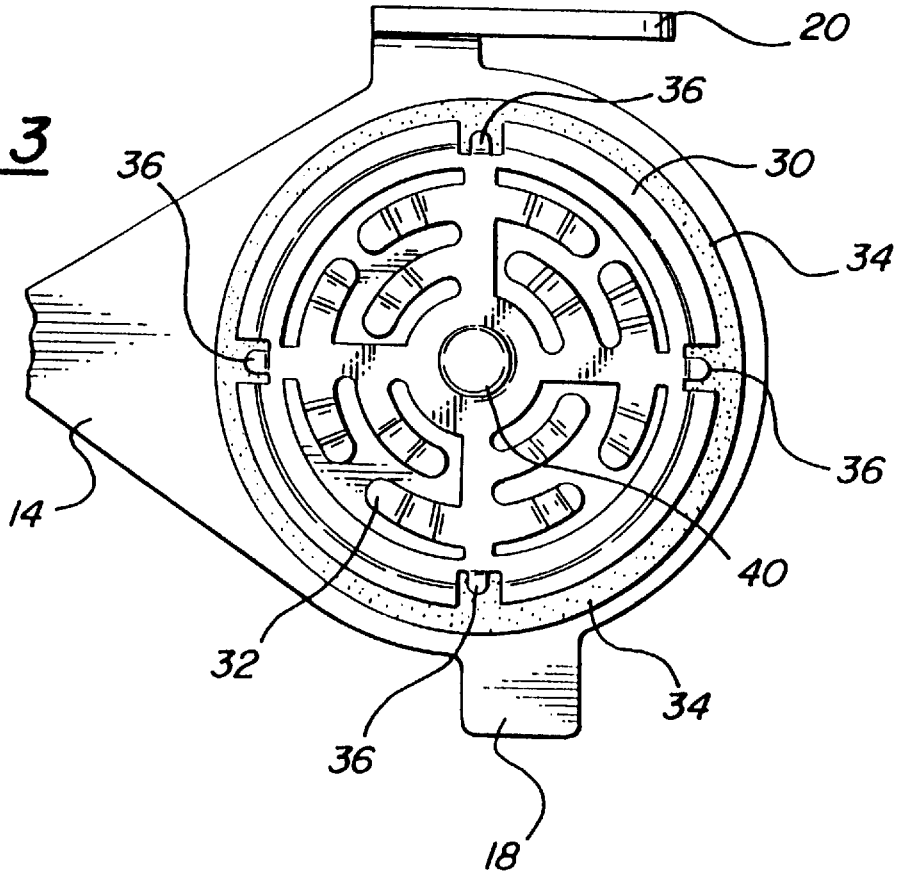
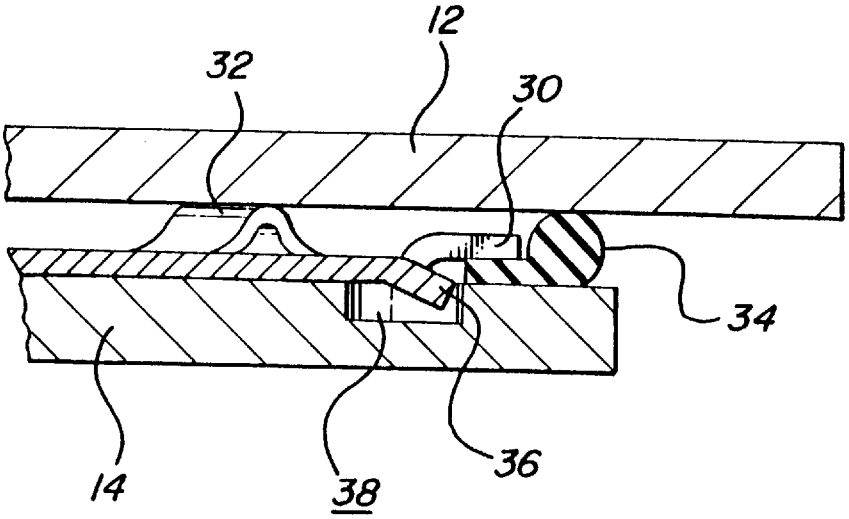
FIG-4

ELECTRICAL CONNECTOR

This is a continuation of application Ser. No. 08/576,782 filed on Dec. 21, 1995 abandoned.

FIELD OF THE INVENTION

This invention relates generally to electrical connectors. More specifically the invention relates to electrical connectors which establish contact through terminal members having flat faces. Most specifically the invention relates to an electrical connector comprised of a pair of terminals which may be lockably engaged through a rotary motion, and which establish electrical contact through opposed, flat faces.

BACKGROUND OF THE INVENTION

There are a variety of connectors which are employed to establish electrical communication between pairs of conductors and/or various electrical components. The configuration of, and performance criteria for, a particular connector will depend upon its application. In general, electrical connectors should present a low electrical resistivity and should be easy to assemble and disassemble. In most instances it is important that the connectors be low in cost and easy to manufacture. In particular applications it is important that an electrical connector be capable of handling high voltage and/or current loads. In vehicular applications, it is often necessary that connectors be capable of providing an environmentally sealed connection, and that they provide a positive connection which is not loosened by vibration, stress, thermal cycling and so forth.

Because of the increasing sophistication of the electrical and electronic systems of motor vehicles, the design and selection of electrical connectors for vehicular use is of increasing importance. Motor vehicles now include control and monitoring systems which include many discrete components together with a number of complex wiring harnesses. Electrical connectors utilized in motor vehicles generally encounter significant vibration as well as harsh ambient conditions. Frequently such connectors carry relatively high currents, and in some instances critical safety systems are dependent upon the establishment and maintenance of reliable electrical connections. In addition to the foregoing, manufacturing criteria for the mass production of motor vehicles requires that electrical connectors employed therein be relatively low in cost and simple to use.

One particular type of connector establishes electrical communication between a pair of terminals via relatively large, flat contact surfaces. U.S. Pat. No. 3,316,522 discloses one such electrical connector comprised of a pair of flat, circular terminals which rotationally engage one another. As shown therein, a separate, resilient lock strip is employed to maintain a positive electrical connection between the engaged terminals. U.S. Pat. No. 3,480,903 and U.S. Pat. No. 4,357,070 both disclose electrical connectors in which pairs of terminals rotationally engage one another.

The present invention provides an electrical connector which is capable of handling relatively large amounts of current, and which provides a positive locking connection, not prone to loosening by vibration, thermal cycling, mechanical shock or the like. The connector of the present invention is simple to use, and does not employ any separate clips or components. The connector provides a tight, resilient and atmospherically sealed connection. The connector of the present invention may be employed to establish electrical contact between conductor pairs and/or components, and is particularly well suited for vehicular applications. These and other advantages of the present invention will be readily apparent from the drawings, discussion and description which follow.

BRIEF DESCRIPTION OF THE INVENTION

There is disclosed herein an electrical connector which comprises a first terminal member and a second terminal member engageable therewith. Each terminal member includes a planar face portion, and the terminal members are configured so that the face portions thereof are in a superposed relationship when the terminal members are engaged. The connector further includes an electrically conductive contact plate which is disposed so as to be between, and in contact with, face portion of the first terminal member and the face portion of the second terminal member when the terminal members are engaged. The contact plate is compressible in a direction perpendicular to the face portions when it is in contact therewith. The connector further includes locking means for reversibly retaining the first and second terminal members in engagement. In particular embodiments, the connector may include an elastomeric seal which is disposed so as to shield the face portions from an ambient atmosphere when the terminal members are engaged. In other instances, the contact plate may be mechanically retained upon the face portion of one of the connectors. The contact plate may comprise a circular member including a plurality of generally elongated contact fingers defined thereupon and disposed so that longitudinal axis thereof is generally parallel to the circumference of the contact plate. In other embodiments, the contact plate may include a detent which engages one of the planar face portions so as to prevent the contact plate from moving relative thereto. In yet other embodiments, the connector is configured to join a number of pairs of conductors together and includes terminal members each comprised of a plurality of terminal units.

The locking means may comprise a tab associated with one of the terminal members and a ramp associated with the other terminal member. The tab and ramp may be configured so that the tab moves along the ramp when the terminal members are rotated relative to one another so as to thereby urge the two terminal members toward one another in a direction perpendicular to the faces thereof.

BRIEF DESCRIPTION OF THE DRAWINGS

FIG. 3 is a top plan view of one of the terminals of the connector of FIG. 1;

FIG. 4 is an enlarged, cross-sectional view of a portion of the connector of FIG. 1;

DETAILED DESCRIPTION OF THE INVENTION

The electrical connector of the present invention comprises a pair of terminal members which establish electrical communication through relatively large, planar face portions. The terminals are preferably configured to be readily locked into engagement by a quarter turn rotation. The connector generally includes a contact plate and a sealing gasket, and may be employed to join pairs of electrical conductors as well as components. In certain embodiments, the connector may include a plurality of terminal units and be operable to join a number of connector pairs together.

Figure 1:
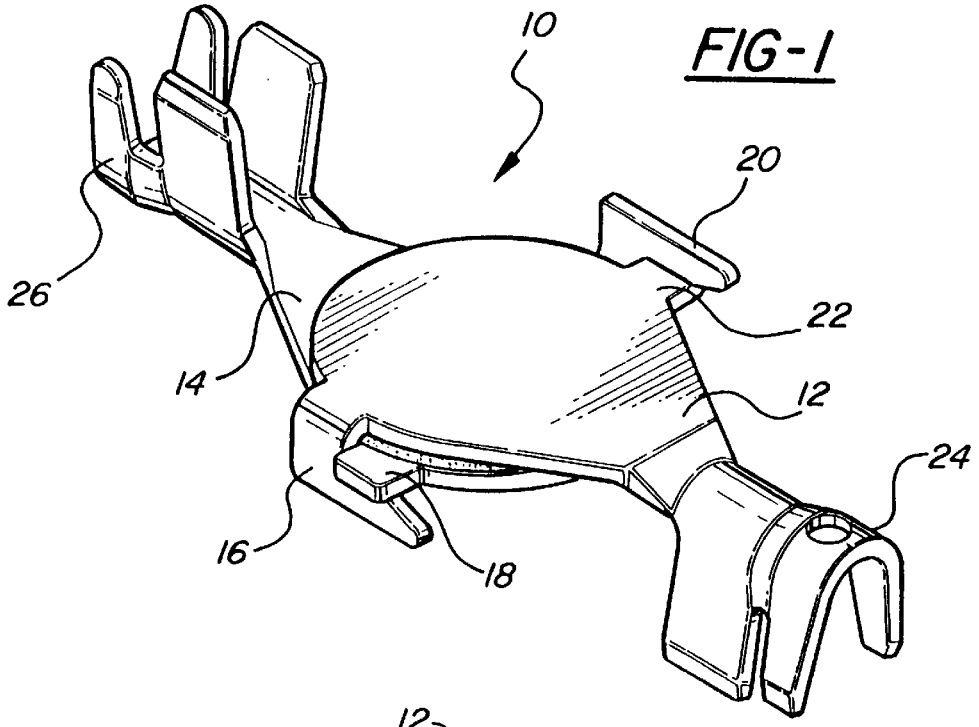
FIG. 1 depicts a connector structured in accord with the principles of the present invention showing the two terminal members thereof in an engaged configuration.

Referring now to FIG. 1, there is shown one particular embodiment of connector 10 structured in accord with the principles of the present invention. The connector 10 includes a first member comprising a first terminal 12 and a second member comprising a second terminal 14 shown in a locked together engagement. As illustrated, a first ramp portion 16 is associated with the first terminal 12, and a first tab portion 18 is associated with the second terminal 14. Similarly, a second ramp portion 20, associated with the second terminal 14, and a second tab portion 22 associated with the first terminal 12 are provided.

In the illustrated embodiment, the terminals 12, 14 include a generally circular portion, and the ramps 16, 20 project from the circumference of the circular portions of the terminals in a generally tangential direction. The tabs 18, 22 project from the terminals 12, 14 in a generally radial direction. The ramps 16, 20 and tabs 18, 22 are configured so that the tab, for example tab 18 will ride up the corresponding ramp, for example 16, as the two terminals are rotated relative to one another. In this manner, the ramp and tab serve to draw the two terminals together in a generally axial direction.

As will be further noted from FIG. 1, each of the terminals 12, 14 includes a crimpable portion 24, 26 which is utilized to establish electrical contact between the respective terminal and electrical conductor such as a wire or cable.

Figure 2:
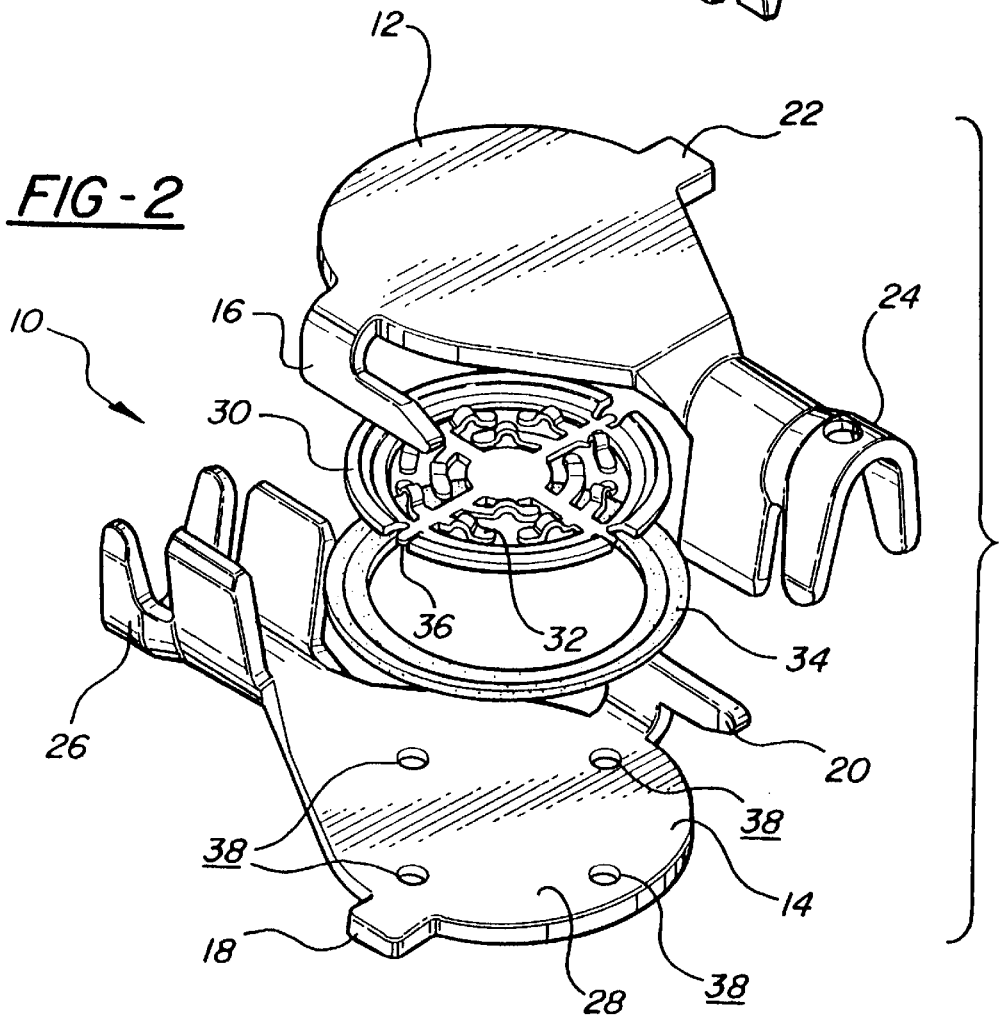
FIG. 2 is an exploded, perspective view of the connector of FIG. 1.

Referring now to FIG. 2, there is shown an exploded view of the connector 10 of FIG. 1. In the connector of the present invention electrical contact between a pair of terminal members, for example members 12 and 14, is established through planar face portions thereof, and in the illustrated embodiment the planar face portion 28 of terminal 14 is visible. When electrical communication between the terminals 12, 14 is established the planar face portion 28 is in a superposed relationship with a corresponding face portion (not visible in FIG. 2) of terminal 12.

As further illustrated in FIG. 2, the connector 10 includes an electrically conductive contact plate 30 which is disposed so as to be between, and in electrical contact with the face portion 28 of the second terminal 14, and the corresponding face portion of the first terminal 12, when the terminals are engaged. The contact plate 30 serves to establish and maintain a positive electrical contact between the two terminals 12, 14; and toward this end, the contact plate 30 is configured so as to be compressible in a direction perpendicular to the face portions of the terminals 12, 14, when those terminals are engaged.

In the illustrated embodiment of FIG. 2, the contact plate 30 includes a plurality of contact fingers, for example finger 32, defined thereupon.

As illustrated, the contact plate 30 is generally circular, and the fingers 32 are generally elongated members aligned so that their long axes are generally parallel to the plane defined by the plate 30, and their short axes are radially aligned with the plate 30. As further illustrated, the fingers 32 are of an arched configuration so as to make them compressible in a direction generally axial to the circular configuration of the contact plate 30.

It has been found that the use of a compressible contact plate enhances the function of the connector by providing a number of contact points between the two faces. In addition, the compressibility of the plate assures that tight contact is maintained even when the connector is subjected to vibration, thermal cycling or other such mechanical stress. This represents an improvement over prior art connectors of the type in which contact is established between two relatively flat, rigid surfaces. In prior art connectors, warpage, or imperfections in the contact surfaces can compromise the planarity thereof and significantly reduce contact area, and hence current carrying capacity. In addition, the non-resilient nature of such prior art connectors can cause a loss of contact as a result of mechanical stress. The contact plate of the present invention greatly enhances the carrying capacity and utility of the connectors of the present invention.

The contact plate 30 of FIG. 2 is illustrated as including a series of contact fingers having their long axes parallel to the circumference of the plate. It has been found that this arrangement permits ready coupling, and establishes a positive electrical communication when the two terminals 12, 14 are placed in a face-to-face orientation, and rotated so as to lock the ramps 16, 20 with their corresponding tabs 18, 22. In such an embodiment, the orientation of the fingers 32 is along the path of rotation of the plate 30 relative to at least one of the faces of the terminals 12, 14. This provides for a smooth coupling action.

Clearly, other configurations of face plate may also be implemented in accord with the present invention. For example, the number of fingers may be made larger or smaller, or the plate may be otherwise configured. The plate may not include discrete fingers but may comprise a unitary member having embossed portions which function to facilitate a connection. In other instances, the member may be configured to include a number of radially projecting fingers, or a single spinal finger. In yet other embodiments, the contact plate may comprise a screen mesh or the like. All of such embodiments are within the scope of the present invention.

The FIG. 2 embodiment also includes a sealing gasket 34 disposed so as to seal the contact plate 30 and face portions of the terminals 12, 14 from an ambient atmosphere when the terminals are locked in engagement. In the illustrated embodiment, the sealing gasket 34 is disposed so as to be retained against the perimeter of the face portion 28 of the second terminal 14, by the contact plate 30.

It will also be noted from the figure that the contact plate 30 includes a plurality of detent portions 36 configured as tabs projecting from the circumference thereof. These detent portions 36 engage corresponding depression 38 in the face portion 28 of the second terminal 14, and function to prevent the contact plate 30 from rotating or otherwise moving out of position when the terminals are being locked and unlocked. Although not illustrated in FIG. 2, in certain embodiments of the present invention, the contact plate 30 may be fixably retained upon one of the terminals, for example terminal 14, by means of a rivet, clinch joint, tack weld or body of adhesive. Retention of the contact plate facilitates handling and assembly of the connectors, and further serves to retain the elastomeric sealing gasket 34 on to the terminal 14.

Referring now to FIG. 3, there is shown a top plan view of the terminal member 14. Depicted therein is a contact plate 30 showing the fingers 32 and the detent tabs 36. In the FIG. 3 embodiment, there is also included a fastener 40 which attaches the contact plate 30 to the face of the terminal 14. As noted above, there are a variety of fasteners which may be employed for this purpose such an interlocked joint of the type disclosed in U.S. Pat. No. 4,459,735. Also visible in the FIG. 3 embodiment is a portion of the sealing gasket 34 disposed about the circumference of the face portion of the terminal member 14.

FIG. 3 also depicts the tab 18 and ramp 20 of the connector 14; and as noted above, the tab 18 projects radially from the terminal, while the ramp 20 projects tangentially. As will be noted in FIG. 3, the ramp 20 is spaced somewhat from the circumference of the face of the terminal 14; but within the context of the present disclosure such a spaced-apart disposition will still be referred to as tangentially disposed insofar as the ramp portion 20 is generally parallel to a line tangent to the circumference. Clearly other embodiments of locking means may be implemented in accord with the present invention. While the FIG. 3 embodiment shows a tab and ramp on the same terminal, one terminal of the pair may include two ramps and the other two tabs. Still other configurations may be employed for locking the two terminals together. For example, a larger number of tabs and ramps may be associated with the terminal. Other locking arrangements may also be employed in connection with the present invention. In some instances, the terminals may include other locking configurations such as a bayonet lock, a screw lock, tabs and slots and the like, all of which are within the scope of the present invention.

Referring now to FIG. 4, there is shown an enlarged cross-sectional view of a portion of the connector of FIG. 1 having two terminals in mated engagement. Illustrated in FIG. 4 is a portion of the first terminal 12 and the second terminal 14 taken near the edges thereof. As illustrated, a sealing gasket 34 is disposed between, and compressed by, the two terminals 12, 14. One portion of the gasket 34 is retained between an edge portion of the contact plate 30 and the second terminal 14 so as to be held captive thereagainst. As illustrated in FIG. 4, a detent tab 36 of the contact plate 30 projects into an opening 38 formed in the face portion of the second terminal 14, and as noted above functions to prevent the contact plate 30 from moving relative to the terminals 12 and 14. As further illustrated in FIG. 4, a contact finger 32 defined upon the contact plate 30 engages the terminals 12, 14 and establishes electrical communication therebetween. As illustrated, the contact finger 32 is arched so as to make the contact plate 30 compressible in a direction perpendicular to the faces of the terminals 12, 14, when they are engaged.

Figure 5B:
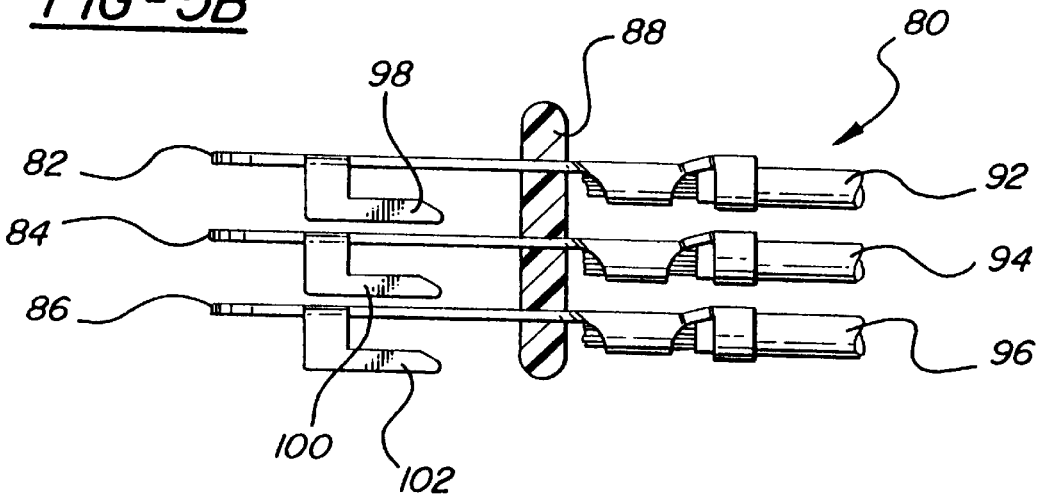
FIG. 5A and 5B are side elevational views of a first and a second multi-terminal array which form a multi-pair connector structured in accord with the present invention; and, FIG. 6 is a side elevational view of the multi-terminal arrays of FIGS. 5A and 5B in an engaged configuration.
Figure 5A:
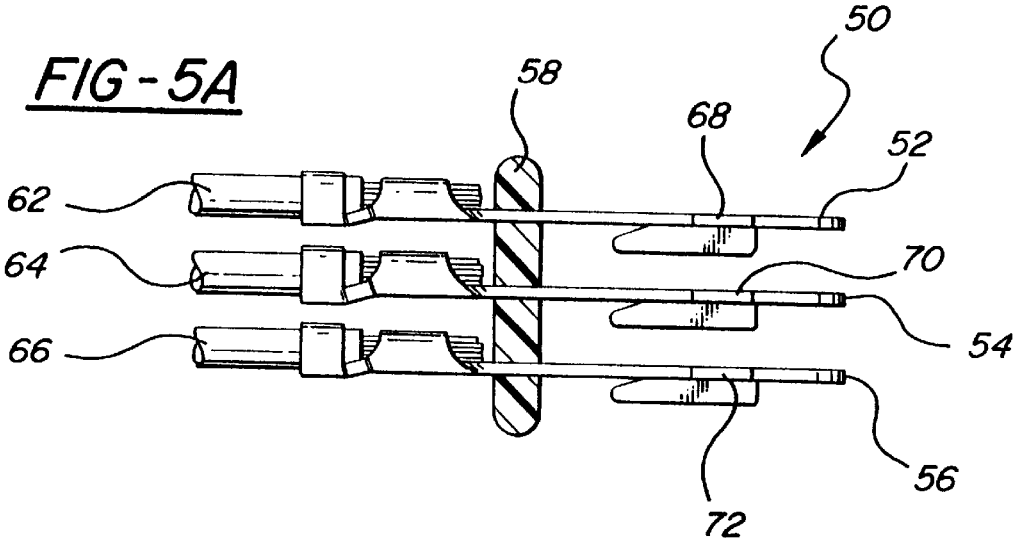
Figure 6:
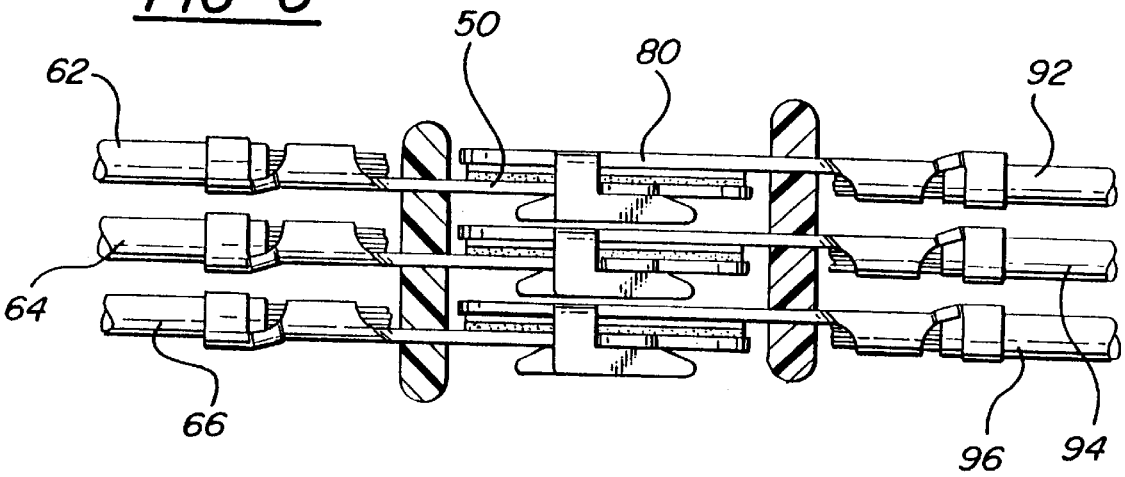

The connector of the present invention may be configured to comprise a first member including a plurality of first terminal units and a second member including a plurality of second terminal units. This particular embodiment may be used as a multi-pair connector. One embodiment of such multi-pair connector is illustrated in FIGS. 5*a*, 5*b* and 6. Referring now to FIG. 5*a*, there is shown a first member of a multi-pair connector 50, which in this embodiment is comprised of three terminal units 52, 54 and 56, shown herein in side elevational view. The units 52, 54 and 56 are each generally similar to terminals 12, 14 illustrated with reference to FIGS. 1–4. The terminal units 52, 54, 56 are joined together by a support member 58 which passes through one end of all three terminal units 52, 54, 56 and maintains them in a spaced apart relationship. Each of the terminal units 52, 54, 56 has an electrically conductive wire 62, 64, 66 associated therewith. Each terminal unit 52, 54, 56 further includes a tab portion 68, 70, 72 projecting therefrom.

A mating terminal member 80 is depicted in FIG. 5*b*. The member 80 in FIG. 5*b* corresponds generally to the member 50 of FIG. 5*a* and includes three terminals 82, 84, 86 maintained in a spaced-apart relationship by a connector 88. Each terminal unit 82, 84, 86 has an electrically conductive wire 92, 94, 96 associated therewith, and each includes a ramp portion 98, 100, 102 projecting therefrom.

The terminal members 50, 80 of FIGS. 5*a* and 5*b* may be readily interconnected by turning the two members slightly relative to one another, engaging the corresponding ramps and tabs, and rotating the connectors so as to lock the ramps and tabs together as in the foregoing embodiments. Referring now to FIG. 6, there is shown an assembled multi-pair connector comprised of the first terminal unit 50 and the second terminal unit 80. The assembled connector of FIG. 6 establishes electrical communication between wires 62 and 92; 64 and 94; and 66 and 96. In accord with the principles disclosed herein, still greater numbers of connector pairs may be joined.

Yet other embodiments of connector are possible within the scope of the present invention. For example, in some instances, the elastomeric seal may be dispensed with, while in other instances, the seal may be otherwise configured. As noted above, the contact plate may be otherwise configured. The terminal members are illustrated herein as having generally circular faces, but it is to be understood that in some instances, other shapes may be advantageous. While the terminals are shown herein as coupled to electrically conductive wires, it is to be understood that one or more of the terminals of the connector may be affixed to or integral with a component such as an alternator, a lamp housing, a battery or the like. In some instances, one of the terminals 12, 14 could comprise a contact member, bus bar or like member configured to include a planar face portion and locking means such as the tabs and/or ramps described hereinabove. A terminal thus configured could be associated with a component, with a circuit board or with a larger current carrying bus.

The foregoing drawings, discussion and description are meant to illustrate particular embodiments of the invention, but are not meant to be limitations upon the practice thereof. It is the following claims, including all equivalents, which define the scope of the invention.

I claim:

1. An electrical connector comprising:

a first terminal member and a second terminal member engageable therewith, each terminal member including a planar face portion, said terminal members being configured so that the face portions thereof are in a superposed relationship when said terminal members are engaged;

an electrically conductive contact plate disposed so as to be between, and in contact with, the face portion of said first terminal member and the face portion of said second terminal member, when said terminal members are engaged, said contact plate being compressible in a direction perpendicular to one of said face portions when it is in contact therewith; and locking means for reversibly retaining said first and second terminal members in engagement including a tab associated with one of said terminal members and a ramp associated with the other of said terminal members; said ramp being operative to engage with said tab and prevent further rotational movement between said engaged terminal members.

2. A connector as in claim 1 wherein said contact plate is mechanically retained on the face portion of one of said terminals.

3. A connector as in claim 1, wherein said contact plate is a circular member which includes a plurality of generally elongated contact fingers defined thereupon, each contact finger having a longitudinal axis and a transverse axis, said contact fingers being oriented so that the longitudinal axes thereof are parallel to a plane defined by said circular contact plate.

4. A connector as in claim 1, wherein said contact plate includes a detent which engages one of said planar face portions so as to prevent the contact plate from moving relative thereto.

5. A connector as in claim 1, wherein the planar face portions of each of said first and second terminal members is of a generally circular configuration, and wherein said tab projects radially from one of said terminal members, and the ramp projects tangentially from the other of said terminal members; whereby rotation of the first terminal member relative to the second terminal member will cause the tab to move along the ramp and to thereby urge the two terminal members toward one another, in a direction perpendicular to the faces thereof.

6. An electrical connector as in claim 1, wherein said first terminal member and said second terminal member are each an array comprised of a plurality of terminal units joined in a spaced apart relationship and wherein each terminal unit includes a face portion, said connector further including a plurality of said contact plates, said plates being disposed so as to be in contact with a face portion of one of said terminal units of said first terminal member and a face portion of one of said terminal units of said second terminal member, when said terminal members are engaged.

7. A connector as in claim 1, further including an elastomeric seal disposed so as to shield said face portions from an ambient atmosphere when said terminal members are engaged.

8. A connector as in claim 7, wherein said seal is retained between said contact plate and the face portion of one of said terminal members.

9. An electrical connector comprising a first terminal member and a second terminal member engageable therewith, each terminal member including a generally circular, planar, face portion, said terminal members being configured so that the face portions thereof are in superposed relationship when said terminal members are engaged;

an electrically conductive, generally circular contact plate disposed so as to be between, and in contact with the face portion of said first terminal member, and the face portion of said second terminal member, when said terminal members are engaged, said contact plate being axially compressible;

an elastomeric sealing member disposed about the periphery of one of said face portions, said sealing member being engageable with the other of said face portions when said terminal members are engaged, and being operable to seal said planar face portions from an ambient atmosphere; and a locking tab projecting radially from one of said face portions, and a locking ramp projecting tangentially from the other of said face portions, said tab and ramp being configured so that when said first and second terminals are disposed so that the face portions thereof are in said superposed relationship, and when said face portions are rotated relative to one another, said ramp engages said tab and axially biases said face portions toward one another.

10. An electrical connector as in claim 9, wherein said contact plate is fixedly retained upon one of said face portions.

11. An electrical connector as in claim 9, wherein said sealing member is fixedly retained upon one of said face portions.

* * * * *